US011649703B2

(12) United States Patent
Metzger et al.

(10) Patent No.: US 11,649,703 B2
(45) Date of Patent: May 16, 2023

(54) PREFERENTIAL FRAGMENTATION OF CHARGE CASE DURING PERFORATING

(71) Applicant: Halliburton Energy Services, Inc., Houston, TX (US)

(72) Inventors: Jason Paul Metzger, Joshua, TX (US); Camille Anne Bryant, Cleburne, TX (US); Richard Calvin Nelms, Burleson, TX (US); Christopher C. Hoelscher, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/321,192

(22) Filed: May 14, 2021

(65) Prior Publication Data

US 2022/0364444 A1 Nov. 17, 2022

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
CPC .... E21B 43/117; E21B 43/116; E21B 43/119; E21B 43/11; E21B 43/1185; F42B 12/32; F42B 12/22; F42B 12/24
See application file for complete search history.

(56) References Cited

U.S. PATENT DOCUMENTS 3,021,784 A * 2/1962 Meddick ..... F42B 3/08 102/493
6,484,642 B1 11/2002 Kuhns et al.
6,487,973 B1 12/2002 Gilbert, Jr. et al.
7,430,965 B2 10/2008 Walker
7,775,279 B2 8/2010 Marya et al.
7,971,535 B1 7/2011 Kim et al.
9,671,201 B2 6/2017 Marya et al.
9,695,677 B2 7/2017 Moody-Stuart et al.
(Continued)

FOREIGN PATENT DOCUMENTS

EP 2966398 A1 * 1/2016 ..... F42B 1/02
WO 2016-100594 6/2016

OTHER PUBLICATIONS

International Search Report and Written Opinion for Application No. PCT/US2021/033730, dated Feb. 9, 2022.

*Primary Examiner* — Daniel P Stephenson
(74) *Attorney, Agent, or Firm* — John Wustenberg; C. Tumey Law Group PLLC

(57) ABSTRACT

A perforating apparatus and method are disclosed wherein voids and inclusions may be configured to promote fragmentation of the charge case into pieces of less than a target size. In one example, the charge case of a shaped charge has a plurality of inclusions of a material interspersed with a plurality of voids of the material to promote fragmentation of the charge case. The inclusions and voids may be disposed along the periphery, such as along a mounting flange. In some examples, the voids may be holes of any of a variety of shapes, geometries, and positioning formed in the parent material of the charge case. In other examples, pieces of hardened material may be embedded in the parent material of the charge case to displace the parent material as well as to initiate probable locations of fragmentation.

20 Claims, 9 Drawing Sheets

(56) References Cited

U.S. PATENT DOCUMENTS

| | | | | |
|---|---|---|---|---|
| 10,161,723 | B2 * | 12/2018 | Hales | F42B 12/24 |
| 2015/0316359 | A1 | 11/2015 | Hales et al. | |
| 2016/0153267 | A1 | 6/2016 | Walker et al. | |
| 2017/0175500 | A1 | 6/2017 | Robey et al. | |
| 2017/0191354 | A1 | 7/2017 | Acker et al. | |
| 2018/0195372 | A1 | 7/2018 | Robey et al. | |
| 2018/0216445 | A1 | 8/2018 | Collins et al. | |
| 2020/0386085 | A1 | 12/2020 | Badii et al. | |
| 2021/0032963 | A1 | 2/2021 | Robey et al. | |
| 2021/0054724 | A1 | 2/2021 | Robey et al. | |
| 2021/0055091 | A1 | 2/2021 | Harrington et al. | |

* cited by examiner

RIM DEBRIS PIECES OVER 10mm PER CHANGE

| LENGTH OF PIECES | AVG. LENGTH | AVG. TOTAL WEIGHT | PIECES |
|---|---|---|---|
| 10-20 mm | ~15 mm | 4.4 g | 4-10 |

RIM DEBRIS PIECES OVER 10mm PER CHANGE

| LENGTH OF PIECES | AVG. LENGTH | AVG. TOTAL WEIGHT | PIECES |
|---|---|---|---|
| 12-13 mm | ~12 mm | 0.5 g | 0-1 |

PREFERENTIAL FRAGMENTATION OF CHARGE CASE DURING PERFORATING

BACKGROUND

After drilling the section of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic opening or perforation must be made through the casing string, the cement and a short distance into the formation.

Perforations are created by detonating a series of shaped charges located within the casing string that are positioned adjacent to the formation. One or more charge carriers are loaded with shaped charges that are connected with a detonating device, such as detonating cord. The charge carriers are then connected within a tool string that is lowered into the cased wellbore at the end of a conveyance such as a tubing string, wireline, slickline, or coiled tubing. The charge carriers are positioned in the wellbore with the shaped charges adjacent to the formation to be perforated. Upon detonation, each shaped charge creates a jet that blasts through a scallop or recess in the carrier. Each jet creates a hydraulic opening through the casing and the cement and enters the formation forming a perforation.

When the shaped charges are detonated, numerous metal fragments are created due to, among other things, the disintegration of the metal casings of the shaped charges. These fragments often fall out or are blown out of the holes created in the carrier. As such, these fragments become debris that is left behind in the wellbore. It has been found that this debris can obstruct the passage of tools through the casing during subsequent operations. This is particularly problematic in the long production zones that are perforated in horizontal wells as the debris simply piles up on the lower side of such wells. The debris can also get trapped in pumps, impellers, and other down hole tools causing failures in subsequent operation and non-productive time (NPT).

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are perforating apparatus and methods for preferential fragmentation of charge cases during perforating. The various apparatus may include a perforating gun or system, an assembly of the perforating gun or system, and may have a charge case that provides preferential fragmentation according to this disclosure. To the user, certain features of the perforating system may look and function similar to other systems, but with internal differences in the charge case. By incorporating inclusions and voids into the charge case, a perforating operation may create controlled debris, and leave acceptable sized material in the well bore that can easily pass through pumps, impellers and other down hole tools. The voids and inclusions may be concentrated along the periphery where larger fragments are more likely to occur in a conventional charge case. In some examples, the charge case includes a mounting flange on its periphery for mounting to a charge carrier. Voids may be formed in the vicinity of the mounting flange in an effort to minimize or eliminate fragments larger than a target rim debris length.

The number and size of fragments of a charge case above a certain target rim debris length may accordingly be reduced or eliminated so that any fragments do not appreciably interfere with downhole equipment. Broadly, the preferential fragmentation is achieved by forming the charge case with particular arrangement of voids and inclusions around the periphery. These voids and inclusions may be introduced during manufacturing using cost-effective manufacturing operations. The voids can be created, in at least some embodiments, by forming holes in the flange such as by machining, stamping, forging, casting, or other suitable manufacturing processes. The voids in other embodiments can be created by displacing the parent material of the charge case with a foreign (e.g. hardened) material.

Inclusions in other embodiments can be created by a method of material processing that result in a micro-effected area that results in the controlled condition of the charge case rim. Various methods of heat treatment to provide hardening or embrittlement are possible. Lasers, for example, are a suitable option, and may be the most practical option for high-volume shaped charge case manufacturing. A laser may be used for heat treating or etching of the surface to induce localized embrittlement of material that forms the preferred fragmentation of the charge case.

Figure 1:
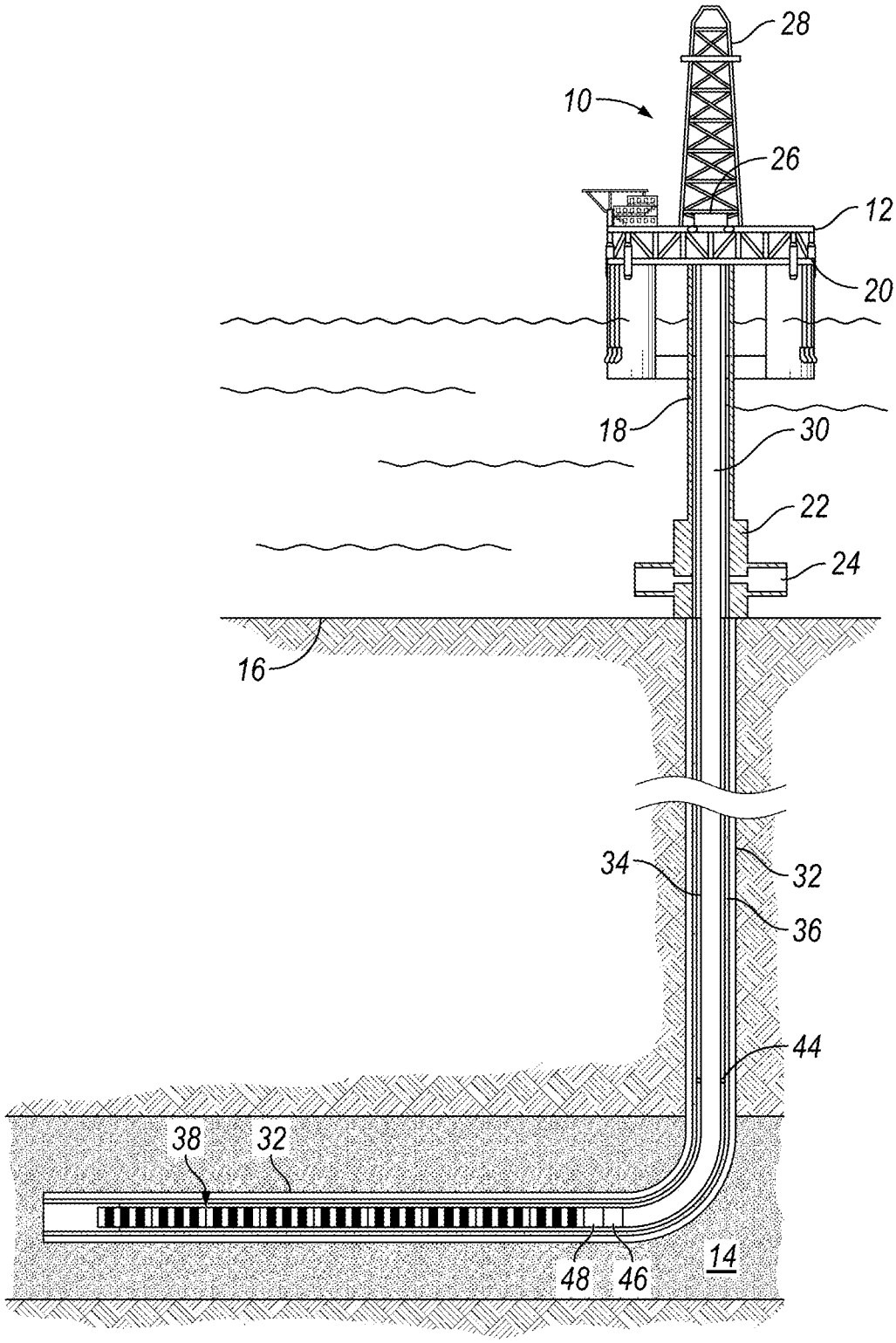
FIG. 1 is an elevation view of a wellsite as an example environment in which a perforating gun and method according to this disclosure may be implemented.

FIG. 1 is an elevation view of a wellsite 10 as an example environment in which a perforating gun and method according to this disclosure may be implemented. The wellsite 10 is depicted by way of example as an offshore wellsite. However, those of ordinary skill in the art will appreciate that aspects of this disclosure are also well suited to use with other types of wellsites, including land-based oil and gas drilling and production. The offshore wellsite 10 includes a semi-submersible platform 12 centered over a submerged oil and gas formation 14 located below sea floor 16. A subsea conduit 18 extends from a deck 20 of the semi-submersible platform 12 to a wellhead installation 22 that includes subsea blow-out preventers 24. The platform 12 has a hoisting apparatus 26 and a derrick 28 for raising and lowering pipe strings such as work sting 30. The work string 30 may be used as a conveyance for a perforating gun in this case, although any suitable conveyance may be used depending on the situation, such as a wireline, slick line, tubing string, or coiled tubing.

A wellbore 32 extends through the various earth strata of the formation 14. The wellbore 32 may be drilled with any given wellbore path using directional drilling techniques as necessary, resulting in any number of wellbore sections that deviate from vertical. In this example, the wellbore 32 has a generally vertical portion from the sea floor 16 and a horizontal section below that. It should be noted, however, by those skilled in the art that the debris retention perforating guns of the present invention are equally well-suited for use in other well configurations including, but not limited to, inclined wells, wells with restrictions, non-deviated wells and the like.

A wellbore casing 34 is cemented within a wellbore 32 by cement 36, which lines and reinforces the wellbore 32. The tubular work string 30 may provide various tools involved in perforating, such as a plurality of perforating guns 38, along with electrical power and signal communication pathways. To perforate the casing 34, the work string 30 may be lowered through casing 34 until the perforating guns 38 are positioned as desired relative to the formation 14. Thereafter, the shaped charges within the string of perforating guns 38 are sequentially fired, either in an uphole to downhole or a downhole to uphole direction. Upon detonation, the liners of the shaped charges form jets that create a spaced series of perforations extending outwardly through the casing 34, cement 36 and into the formation 14. These perforations allow fluid communication between the formation 14 and the wellbore 32.

The work string 30 includes a retrievable packer 44 that may be sealingly engaged with casing 34 in vertical portion of the wellbore 32. At the lower end of work string 30 is the gun string including the plurality of perforating guns 38, a ported nipple 46 and a time domain fire device 48. In the illustrated embodiment, perforating guns 38 are preferably internally oriented perforating guns which allow for increased reliability in orienting the shaped charges to shoot in the desired direction or directions. Examples of perforating gun components and assemblies thereof, including various shaped charge configurations for reducing fragments, are further disclosed below along with associated methods.

Figure 2:
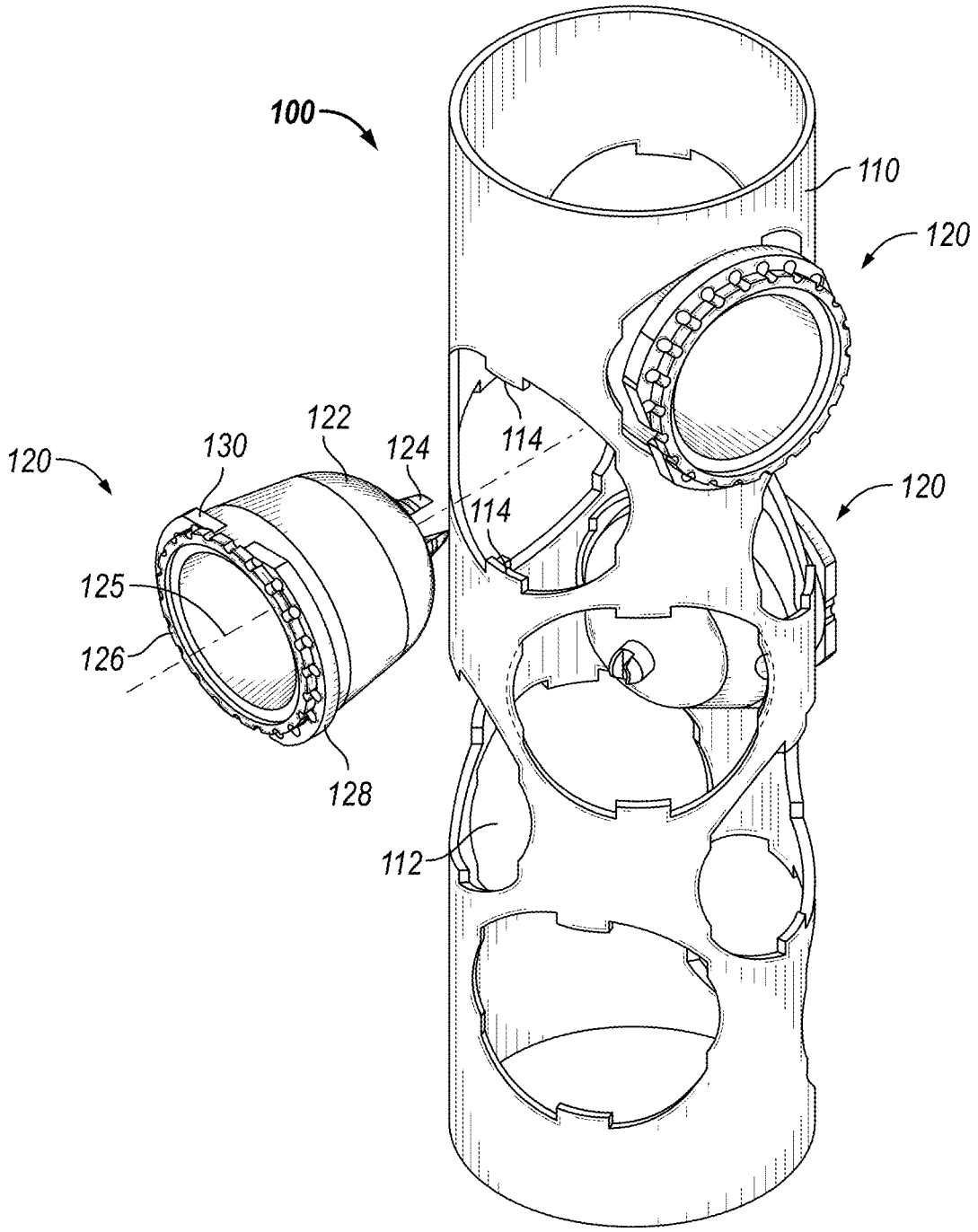
FIG. 2 is a perspective view of one example of a perforation gun assembly including a charge carrier for mounting a plurality of shaped charges at predetermined firing orientations.

FIG. 2 is a perspective view of one example of a perforation gun assembly 100 including a charge carrier 110 for mounting a plurality of shaped charges 120 at predetermined firing orientations. The charge carrier 110 in this example includes a generally cylindrical structural tube having a plurality of mounting holes 112, each for receiving one of the shaped charges 120. Two of the shaped charges 120 are mounted to the charge carrier 110 in their respective mounting holes 112 in the figure. Another one of the shaped charges 120 on the left side of the figure is shown aligned for insertion into the respective mounting hole 112, and its features are further referenced for purpose of discussion.

Each shape charge 120 includes a charge case 122 that can contain an explosive charge. Each charge case 122 has an initiation end 124 where a detonation cord may attach to detonate the explosive charge, and a discharge end 126 opposite the initiation end 124 where liner material is jetted when the explosive charge is detonated. The charge case 122 may be generally round, and regardless of shape, may define an axis 125 that passes centrally through the charge case 122 from the initiation end 124 to the discharge end 126. The charge case 122 narrows toward the initiation end 124, where it is received into the respective mounting hole 112 in the charge carrier 110. The charge case 122 may be formed with a plurality of voids and inclusions on its periphery (not shown), examples of which are provided in subsequent figures and discussed below.

Each mounting hole 112 may receive one of the shaped charges 120. However, not every mounting hole must be used in any given perforating operation. The selection of mounting holes in which to position a shaped charge 120 may depend, in part, on the desired firing pattern. The spacing of the mounting holes 112 can vary significantly according the firing pattern desired for a particular formation. It is common for the shaped charges 120 to be placed in an angular pattern; although, a single straight line of shaped charges 120 may be appropriate in some circumstances as well. The number of shaped charges 120 per linear foot of the charge carrier 110 is another criterion. It is common for a well engineer to specify between four to six charges per foot of charge carrier, for example.

In any given configuration of a perforating gun assembly according to this disclosure, a retention feature may be provided for each mounting hole that engages the charge case to retain the respective shaped charge received within the mounting hole. Such a retention feature may be any feature that engages the charge case on its periphery to retain the charge case withing the mounting hole. The retention feature may engage the charge case on its periphery near the discharge end. The retention feature may provide interference between the charge case and the mounting hole to prevent the charge case from coming out of the mounting hole, such as a tab on the charge carrier that engages a flange at the periphery.

One non-limiting example of a retention feature shown in the FIG. 2 configuration includes one or more tabs 114 adjacent the mounting hole 112 that cooperate with a flange 128 on the periphery of the charge case 122. More particularly, this example has two tabs 114 at the mounting hole 112 spaced at 180 degrees apart; however, any number of tabs 114 could be used at any of a variety of different angular spacings. The flange 128 projects radially outwardly from the periphery of the charge case 122 to provide a structure that can cooperate to secure the charge case 122 to the charge carrier 110. The flange 128 also extends circumferentially along at least a portion of the periphery of the charge case 122, and is interrupted in this example by two clearance portions, embodied here as opposing flats 130 spaced at 180 degrees apart. An aspect of the retention feature in this example is that the charge case 122 may be inserted axially into the respective mounting hole 112 on the charge carrier 110, oriented as shown, so the tabs 114 on the mounting hole initially clear the flange 128 at the flats 130. Then, the charge case 122 may be rotated (e.g., 90 degrees) so that the flange 128 is captured behind the tabs 114, thus retaining the charge case 122 by interfering with removal of the charge case 122 from that mounting hole 112. A detonation cord may then be coupled to the charge case at the initiation end 124. This can reduce the likelihood of the charge case 122 rotating to a position where the tabs 114 and flats 130 are again adjacent.

In any given configuration, the periphery of the charge case 122 may be formed with a plurality of inclusions of a material interspersed with a plurality of voids of that material. Different example configurations of these inclusions and voids are shown in subsequent figures as discussed below. In some embodiments, the material may be a parent material of the charge case 122, and the voids may be holes formed in the charge case. In other embodiments the voids may be particles of another material that displace the parent material. Generally, these inclusions and voids may cause the charge case to preferentially fragment so that the perforating operation creates controlled debris, and leaves acceptable sized material in the well bore that can easily pass through pumps, impellers and other down hole tools. To the observer, the perforating system may look and function in a way that is comparable to current systems in many respects, such as how the charges may be electrically connected within a perforating system and fired, and their explosive capacities.

Figure 3:
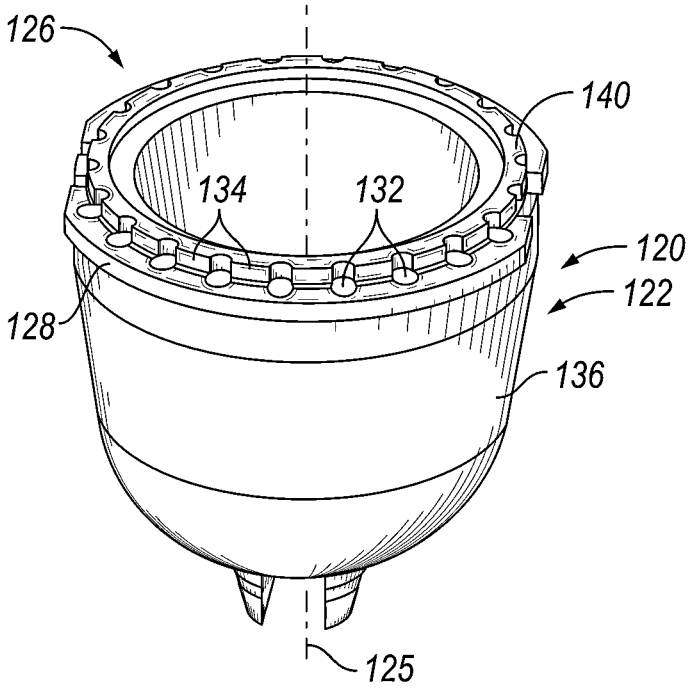
FIG. 3 is a perspective view of the shaped charge according to one configuration wherein a plurality of voids are embodied as holes formed in the parent material of the charge case, and a plurality of inclusions comprise the remaining parent material between the voids.

FIG. 3 is a perspective view of the shaped charge 120 according to one configuration wherein a plurality of voids are embodied as holes 132 formed in the parent material of the charge case 122, and a plurality of inclusions 134 comprise the remaining parent material between the voids (holes 132). The parent material may be a steel or other structural material suitable for containing an explosive charge and mounting to a charge carrier. For example, the overall shape of the charge case 122 with a generally round exterior 136 and a concave interior 138 (see FIG. 4) for receiving an explosive material may initially be cast, stamped, forged, machined, or a combination thereof, from the parent material. The charge case 122 also includes an upper ridge 140, which is radially inward of the flange 128 and extends axially beyond the flange 128 toward the discharge end 126 of the charge case 122.

Certain features of the charge case 122 such as the flange 128 and/or holes 132 may be formed in the same manufacturing step of forming the overall round, concave shape of the charge case 122 or from separate manufacturing steps. For example, although it may be possible to form the flange 128 and/or the holes 132 on the periphery of the charge case 122 by an initial casting or forging, the flange 128 and the holes 132 more typically may be formed in a subsequent manufacturing step such as by machining them into the charge case 122.

The placement, orientation, geometry, and other aspects of the holes 132 in combination with other aspects of the charge case 122 may be selected to facilitate preferential fragmentation of the charge case 122 upon detonation of the shaped charge. The holes 132 in this example are arranged in a single ring of holes that are radially equidistant from the central axis 125 of the charge case 122. The holes 132 extend axially, parallel with the central axis 125 of the charge case 122. The holes clip at least a portion of the upper ridge 140 in this example, as well as extending into the flange 128. Thus, the holes 132 serve as discontinuities in the structure of both the flange 128 and the upper ridge 140. This facilitates preferential fragmentation of the charge case on the periphery in the vicinity of the flange 128 and upper ridge 140, and especially at the discharge end 126 of the charge case 122 where larger fragments may otherwise occur. Toward the detonation end 124, the charge case 122 may fragment into sufficiently large particles, because of the case thickness and mass that these larger particles stay in the gun after detonation. The flange 128 near the discharge end breaks up into smaller particles that can fall out of the gun but, without the arrangements of inclusions and voids disclosed herein, may still be large enough to cause issues as they pass through pumps, impellers and other down hole tools. Therefore, the inclusions and voids in the case help create extra-small case debris that avoids or at least reduces such issues.

Figure 4:
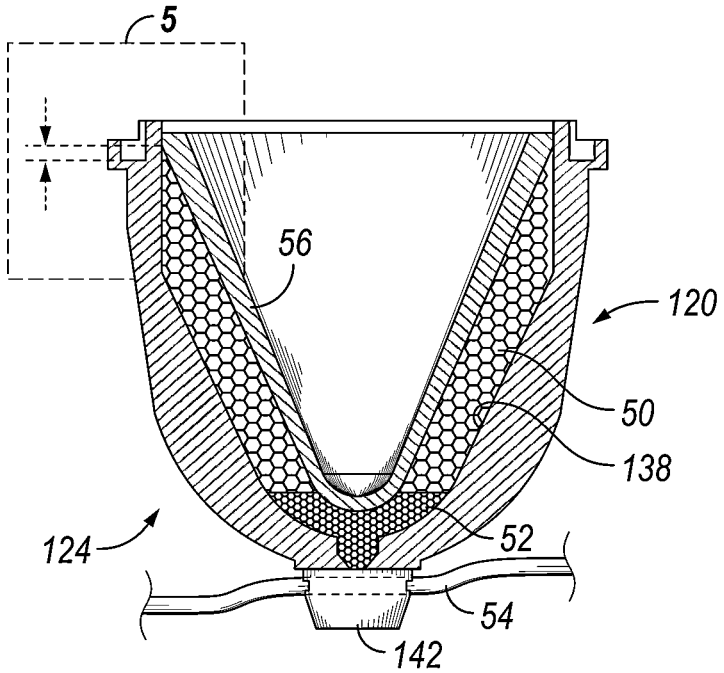
FIG. 4 is a cross-sectional side view of the shaped charge having the charge case configuration of FIG. 3.

FIG. 4 is a cross-sectional side view of the shaped charge 120 having the charge case configuration of FIG. 3. A shaped explosive charge 50 is disposed within the concave interior 138 of the charge case 122. Within the concave interior 138, there is also a booster 52 at the initiation end 124. The booster 52 is generally configured to aid in transferring the explosive detonation from a detonating cord 54 to the shaped explosive charge 50. The booster 52 may be triggered by the detonating cord 54 at the detonation end 124. A passageway may be formed in a base 142 of the charge case 122 for receiving the detonating cord 54 and retaining the detonating cord 54 in a configuration for passing the explosive detonation from the detonating cord 54 to the booster 52 and to the shaped explosive 50 within the charge case 122. A liner 56 is disposed within the charge case 122 over the explosive charge 50.

Figure 5:
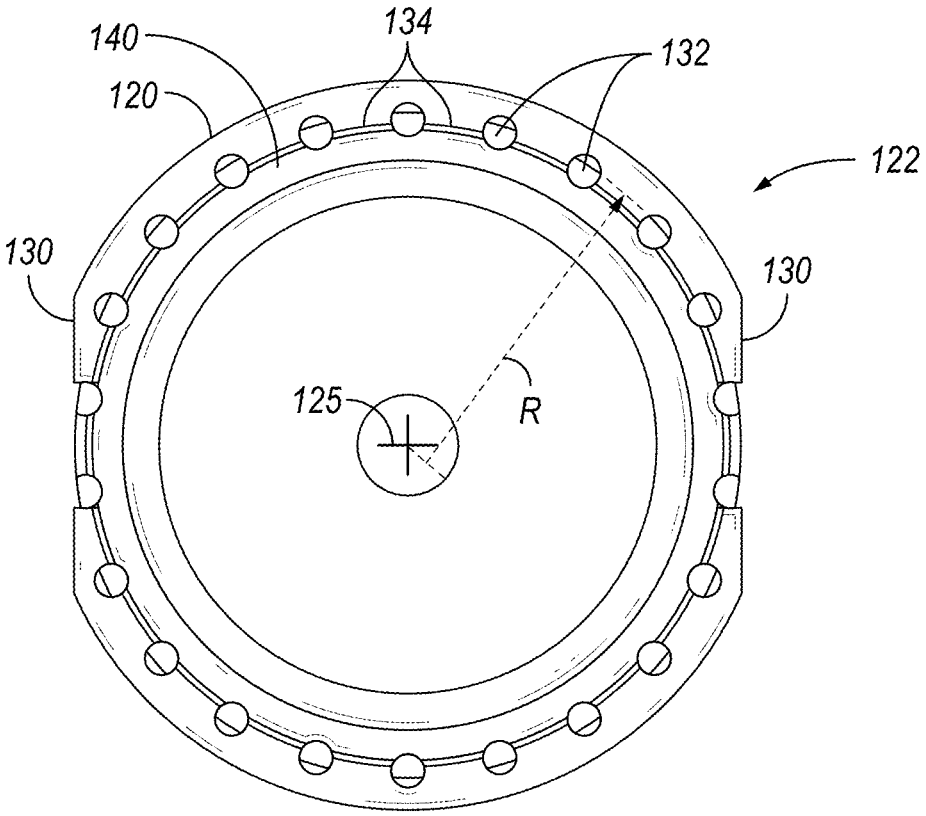
FIG. 5 is a top view of the charge case detailing the example hole configuration of FIG. 4.

FIG. 5 is a top view of the charge case 122 detailing the example hole configuration of FIG. 4. There are a plurality of holes 132 of substantially equal circumferential spacing from each other along the periphery of the charge case 122. Each hole 132 is at substantially the same radius "R" from the central axis 125 of the charge case 122. In this example, the radius "R" positions each hole 132 so that it overlaps with the ridge 140 and the flange 128. The diameter of the holes 132 extends outside the flats 130 of the opposing portions of the flange 128. For evenly spaced holes 132, the center-to-center arc length between holes can be calculated or estimated, such as by $2\pi R$ divided by the number of holes 132. The arc length of material between holes 132 (which is less than the center-to-center arc length) can represent the length of the material inclusion 134 between adjacent holes 132. In one or more examples, an angular spacing of the voids (in this case, holes 132) along the periphery is between 65 to 135% of a target rim debris length in response to detonation of the shaped charge. In one or more examples, the target rim debris length is less than about 10 mm. In other examples, the target rim debris length is less than about 10 mm. In some examples, the voids and inclusion are configured so that the charge case 122 fragments into pieces of less than 10 mm virtually every time (e.g., in at least 95% of detonations).

Figure 6:
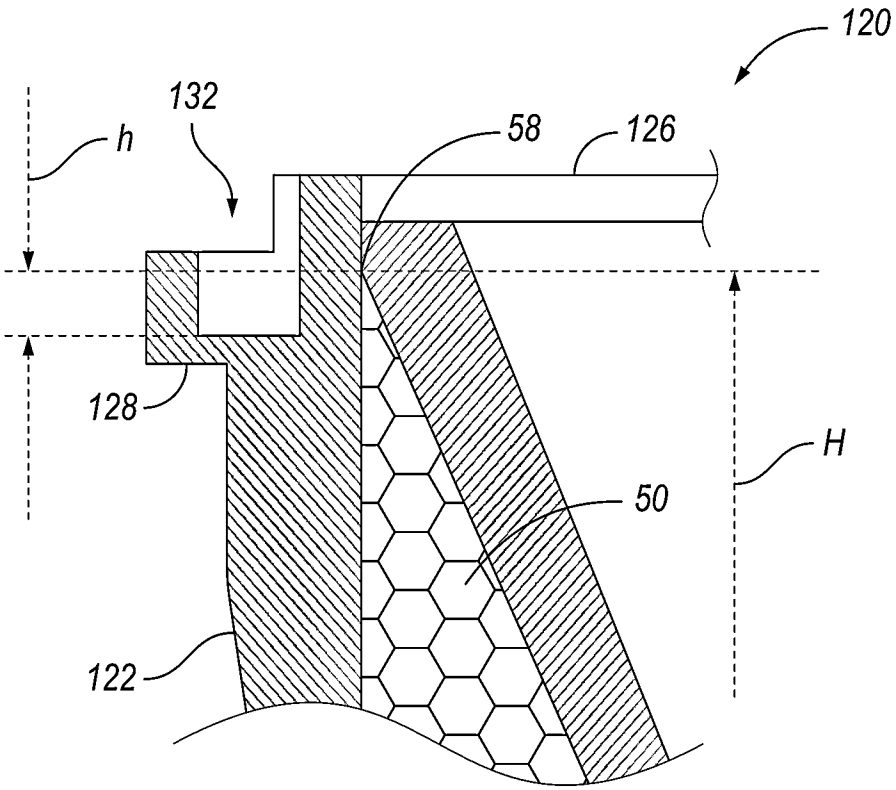
FIG. 6 is an enlarged view of the cross-sectional portion of the shaped charge generally indicated in FIG. 4.

FIG. 6 is an enlarged view of the cross-sectional portion of the shaped charge 120 generally indicated at 5 in FIG. 4. The holes 132 penetrate the periphery of the charge case 122 at the discharge end 126, including at least a portion of the flange 128, in an axial direction. As drawn here, the holes 132 do not pass fully through the charge case 122 nor through the flange 128 in particular (i.e., the holes 132 are not through holes in this example). However, the holes 132 may alternatively pass through the flange 128 in one or more embodiments. The explosive charge 50 has a high point 58 within the charge case 122, which in this example is a vertex or point at 58 where the explosive charge 50 meets the interior of the charge case 122. The explosive charge 50 has a height "H" within the charge case 122 in an axial direction from high point 58 at the discharge end 126 to the initiation end. In at least one range of examples, the holes 132 on the periphery are to a depth of between 0.050 to 0.150 inches below the high point 58 that defines the height H of the explosive charge 50. Thus, the holes 132 axially extend past/below the high point 58 of the explosive charge 50, thus overlapping with the explosive charge 50. This overlap helps to ensure that the explosive charge 50, when detonated, will cause the charge case 122 to yield and preferentially fragment in the vicinity of the holes 132.

Figure 7:
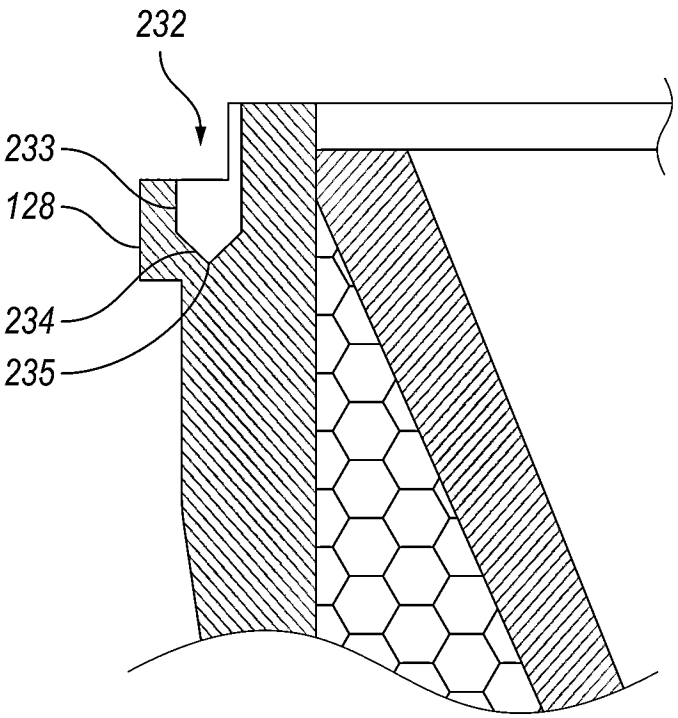
FIG. 7 is an enlarged view of the cross-sectional portion of the shaped charge with an alternative configuration of holes.

FIG. 7 is an enlarged view of the cross-sectional portion of the shaped charge 120 with an alternative configuration of holes 232. The holes 232 may have a similar placement with respect to the flange 128 as the holes 132 in FIG. 5, except the holes 232 in FIG. 6 taper radially inwardly in an axial direction toward the initiation end of the charge case. An initial portion of each hole 232 is a generally cylindrical portion 233. Below the cylindrical portion 233 is a tapered portion 234, which converges at a lowermost point 235 in this example. This tapered portion 234, which may be generally conical in the case of a circular cross-section hole, helps create a stress concentration to facilitate preferential yielding and fragmentation at the holes 232.

Figure 8:
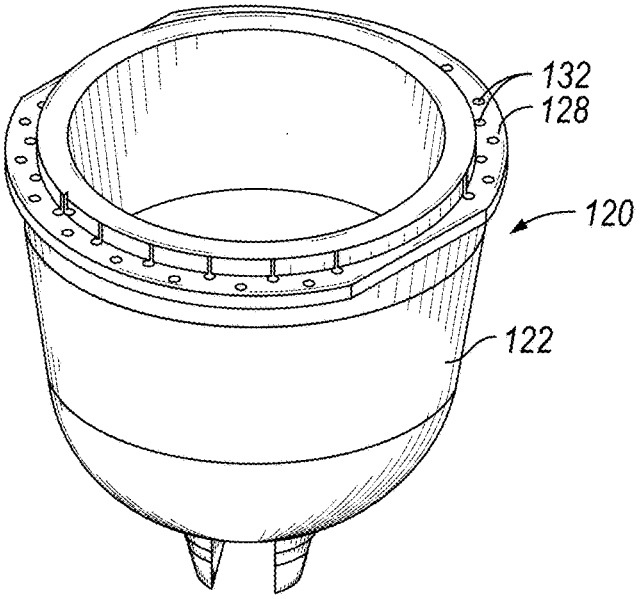
FIG. 8 is a perspective view of the shaped charge according to another example configuration wherein the holes are radially staggered along the periphery of the charge case.

FIG. 8 is a perspective view of the shaped charge 120 according to another example configuration wherein the holes 132 are radially staggered along the periphery of the charge case 122. That is, instead of all of the holes 132 being at substantially the same radius from the center of the charge case 122, the holes alternate between two different radiuses along the flange 128.

Figure 9:
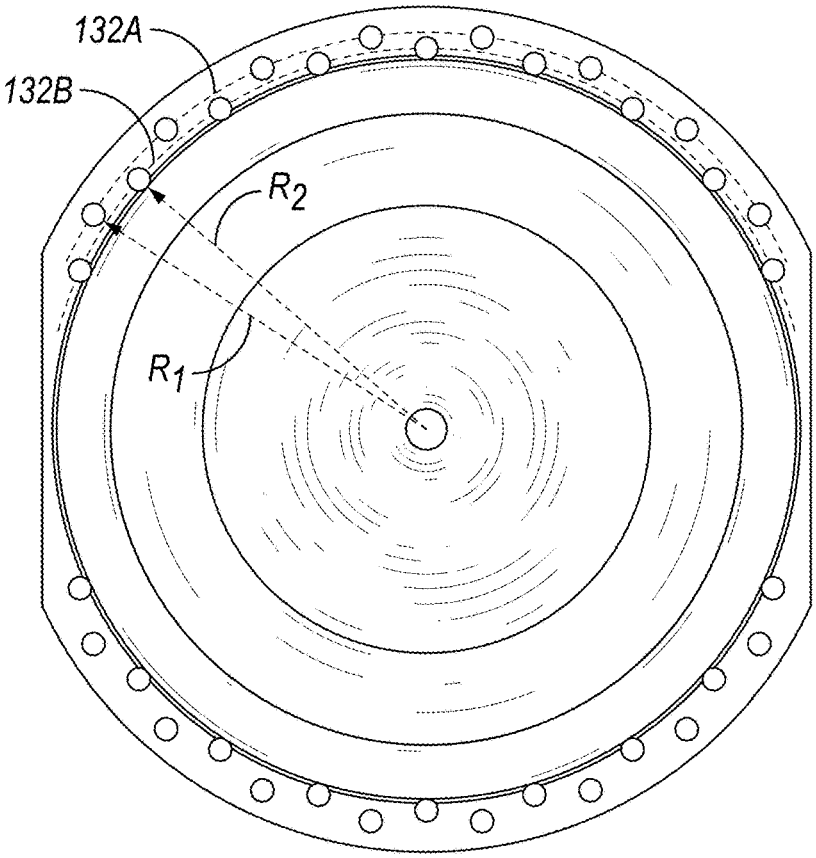
FIG. 9 is a top view of the charge case according to the FIG. 8 configuration.

FIG. 9 is a top view of the charge case according to the FIG. 8 configuration. The radially staggered holes 132 can effectively be regarded as two sets of holes, including a first set of holes 132A at a first radius R1 and a second set of holes 132B at a second radius R2 that is less than the first radius. The spacing between holes 132 of the two sets of holes 132A, 132B is substantially uniform in this example.

In another example configuration, rather than uniformly spaced holes or other voids, the voids could instead comprise multiple clusters of voids, wherein a spacing between the voids in each cluster is less than a spacing between adjacent clusters. Also, there may be a trade-off between the number of holes and the size of the holes in terms of promoting fragmentation. The number of holes could be increased and the size of each hole correspondingly decreased to achieve a desired fragmentation upon detonation.

Figure 10:
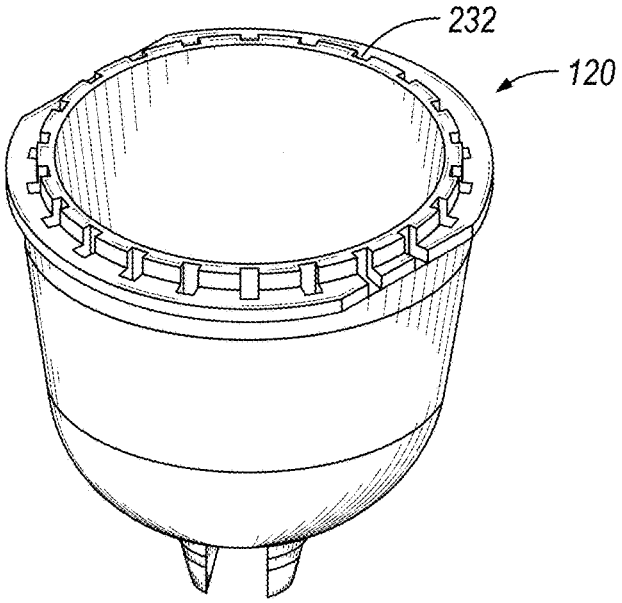
FIG. 10 is a perspective view of the shaped charge according to another example configuration having holes that are non-circular.

FIG. 10 is a perspective view of the shaped charge 120 according to another example configuration having holes 232 that are non-circular. In this example, the holes 232 are generally square or rectangular in cross-section. However, any of a variety of different non-circular hole shapes including linear, symmetrical and even asymmetrical hole shapes are possible. The non-circular holes 232 in this configuration have a similar hole placement to the round holes in FIG. 3. However, any non-circular hole shape can be combined with other features disclosed herein. For example, non-circular holes may be positioned in any of a variety of arrangements including but not limited to the radially-staggered hole arrangement in FIG. 8. Non-circular holes may also go only part way through the casing and not be through holes. Non-circular holes may also be tapered just as the circular holes are tapered in the example of FIG. 7.

Figure 11A:
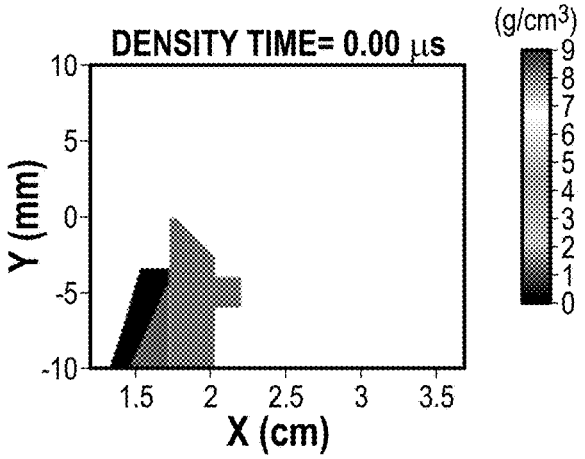
FIG. 11A is a diagram of a spallation of a charge case at time 0.
Figure 11B:
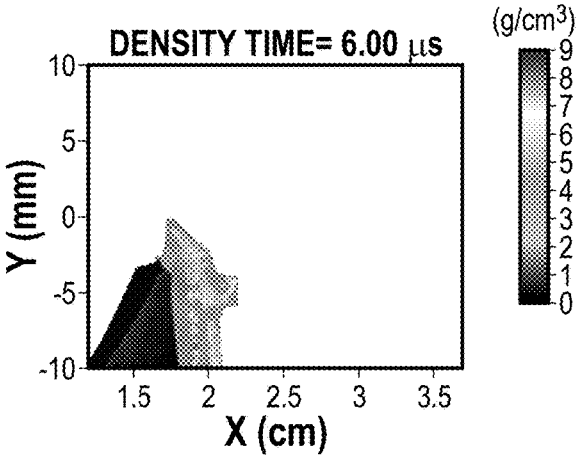
FIG. 11B is a diagram of the spallation of the charge case at time 6 microseconds.

FIGS. 11A and 11B are diagrams of a spallation of a charge case at different points in time, at a selected time interval apart (e.g., 6 microseconds apart). FIG. 11A shows the Density at time 0. FIG. 11B shows the density at time 6 microseconds. These images of case density show the spallation of flange debris caused by the shock wave created by the detonation of the shaped explosive charge 50. Without the presence of voids and or inclusions in the flange, larger flange debris is created. With the introduction of voids and or inclusions into the flange as discussed above, spalling flange material is broken up into small fragments due to the size and location of voids and or inclusions.

Figure 13:
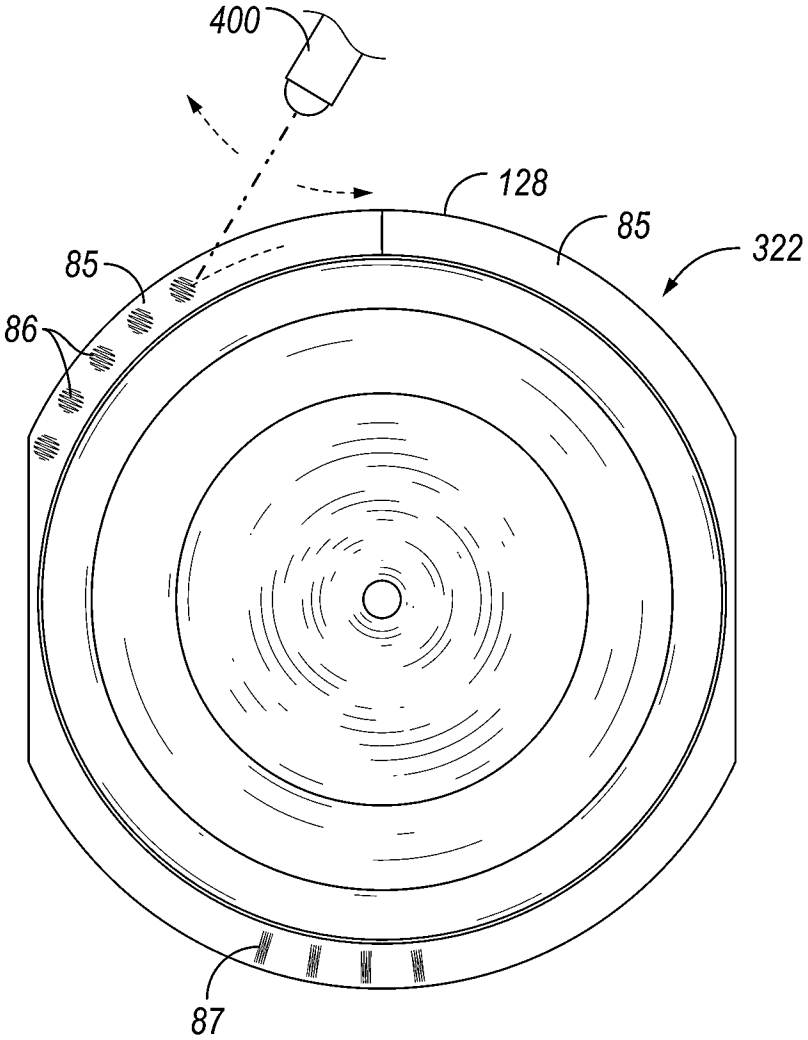
FIG. 13 is a top view of an alternative example configuration wherein the inclusions comprise localized regions where the parent material has had its physical properties altered to provide stress concentrations for the purpose of controlled fragmentation.
Figure 12:
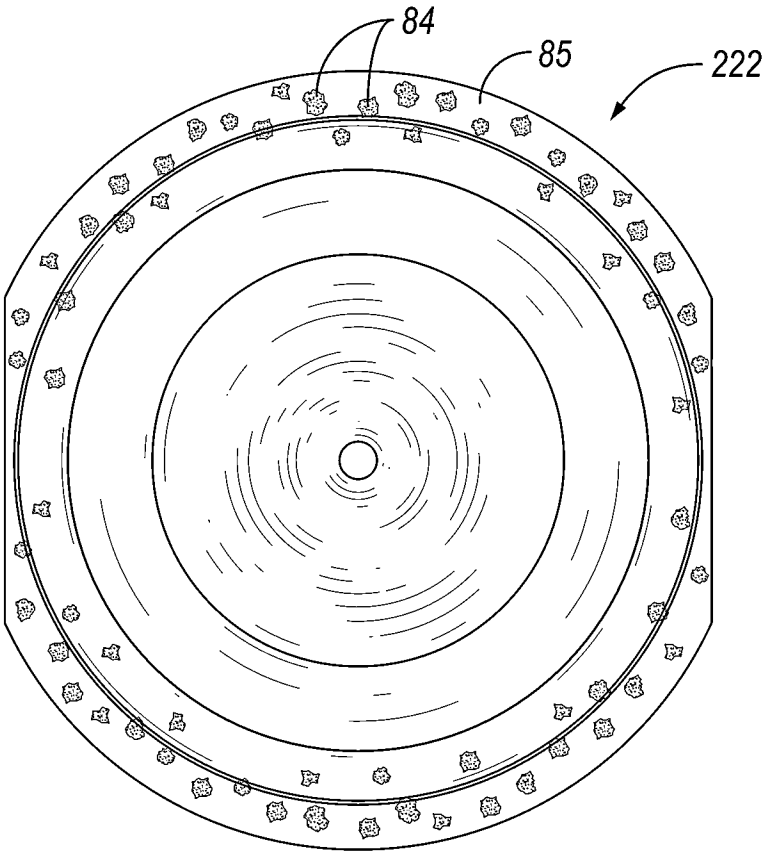
FIG. 12 is a top view of an alternative example configuration of a charge case where pieces of a hardened material are embedded within a parent material of the charge case.

In the preceding example configurations illustrated in the figures, the voids of the material were holes in the parent material of the charge case, which is a structural material, and the inclusions of the material were the remaining structural parent material (e.g., steel) between the holes. FIGS. 12 and 13 illustrate alternative embodiments wherein the charge case is formed of a parent material, and the parent material is interspersed with inclusions having properties dissimilar to that of the parent material (no holes or scoring are required).

FIG. 12 is a top view of an alternative example configuration of a charge case 222 where hardened particles 84 are embedded within a parent material 85 of the charge case 222. The hardened particles 84 may be separately formed, foreign particles of a dissimilar material embedded in the parent material 85 during manufacturing (e.g. molding or casting). For example, the parent material 85 of the charge case may be a steel, and the particles of hardened material 84 could be a carbide, stone, polycrystalline diamond, or other particular other than the parent material that are embedded in the parent material 85 during forming of the charge case 222. These pieces of hardened material 84 may displace the parent material, and create failure initiation sites during detonation. The hardened particles may have an irregular shape as depicted, although round hardened particles or other shapes are also within the scope of this disclosure.

The hardened material 84 may thus further contribute to fragmentation as compared with a hole or empty space in the parent material. The properties of the hardened material 84 differ from the parent material 85. In some cases, the hardened material 84 be harder, stronger, and/or tougher than the parent material 85, so that it deforms differently than the parent material 85 of the charge case in response to an applied stress. The hardened material 84 may also be irregular in shape. The hardened material properties and/or irregular shape may introduce a greater probability of discontinuities and stress concentrations along the periphery. This may still allow sufficient strength prior to detonation, but may facilitate fragmentation of the parent material of the charge case 222 upon detonation.

FIG. 13 is a top view of an alternative example of a charge case 322 wherein the inclusions comprise localized regions 86 and/or 87 where the parent material 85 has had its physical properties altered to provide stress concentrations for the purpose of controlled fragmentation. A laser 400 may be applied to the parent material 85 to create embrittled, high stress shapes (e.g., linear or other shapes) that may score the rim of the charge case to facilitate the desired fragmentation. The depicted shapes of localized regions 86 and/or 87 are just two example of local alteration of properties that could be present, e.g. a generally round shape like localized regions 86 or a scored/linear shape like localized regions 87. In this example, the localized regions 86 and/or 87 are being formed on the parent material by laser-hardening using a laser 400. (Other embrittlement methods may also be used without a laser.) The laser 400 may be used to form the localized regions 86 and/or 87 directly into the parent material 85 at spaced-apart locations as shown. The laser 40 may be used to form such a pattern of localized regions 86 and/or 87 along all or at least a portion of the flange 128.

Figure 14:
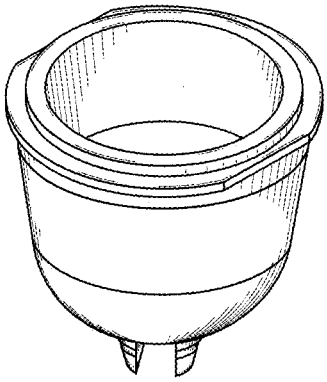
FIG. 14 is a chart summarizing the fragments of flange (rim) debris of a charge case without any voids, over a number of experimental runs.
Figure 14:
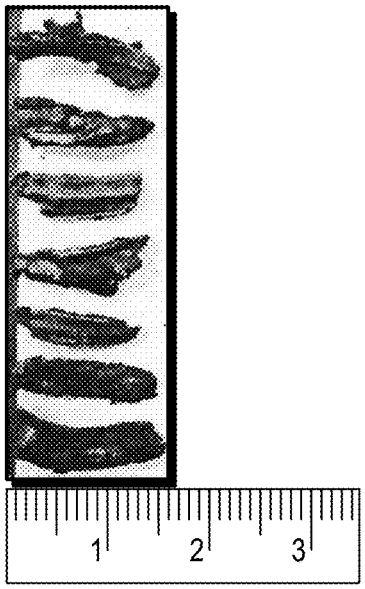
Figure 15:
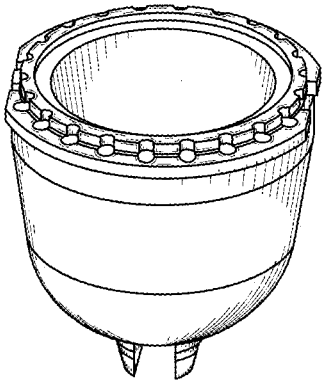
FIG. 15 is a chart summarizing the fragments of flange (rim) debris of a charge case having the arrangement of voids generally depicted in FIG. 3.
Figure 15:
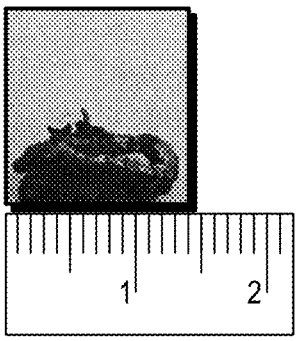

FIGS. 14 and 15 illustrate the efficacy of an embodiment wherein the voids comprise holes in the periphery of a charge case. FIG. 14 is a chart summarizing the fragments of flange ("rim") debris of a charge case without any voids, over multiple experimental runs tested and averaged. The number of fragments recovered was between 4 and 10 fragments per charge case. The average length of fragments recovered was about 15 mm. FIG. 15 is a chart summarizing the fragments of flange (rim) debris of a charge case having the arrangement of holes generally depicted in FIG. 3. In this case, there were very few (0 to 1) fragments recovered. Of these, the average length was 12 mm in length. With the voids included in the charge case, flange debris mass was reduced by 89%.

Accordingly, the present disclosure may provide apparatus and method for preferential fragmentation of charge cases during perforating. The number of large fragments may be reduced or eliminated below a certain target rim debris length, with the rest of the charge case disintegrating into smaller or insignificant fragments. Broadly, the preferential fragmentation is achieved by selecting creating voids and inclusions around the periphery. The voids can be created by machining holes or displacing the parent material of the charge case with a foreign (e.g. hardened) material. The methods/systems/compositions/tools may include any of the various features disclosed herein, including one or more of the following statements.

Statement 1. A shaped charge for a downhole perforating gun, comprising: a charge case having an initiation end and a discharge end, the charge case including a periphery formed of a plurality of inclusions of a material interspersed with a plurality of voids of the material; an explosive charge disposed within the charge case; and a liner disposed within the charge case over the explosive charge.

Statement 2. The shaped charge of Statement 1, further comprising: a mounting flange along the periphery of the charge case for mounting the shaped charge on a charge carrier, wherein the voids are each at least partially on the flange.

Statement 3. The shaped charge of Statement 1 or 2, wherein the material is a parent material of the charge case, the voids of the material comprise holes formed on the periphery of the charge case, and the inclusions comprise the parent material remaining on the periphery of the charge case between the holes.

Statement 4. The shaped charge of Statement 3, wherein the holes penetrate the periphery of the charge case in an axial direction from the discharge end toward the initiation end without passing fully through the charge case.

Statement 5. The shaped charge of Statement 4, wherein the holes taper radially inwardly in an axial direction toward the initiation end of the charge case.

Statement 6. The shaped charge of Statement 4 or 5, wherein the holes have a non-circular cross-section.

Statement 7. The shaped charge of Statement 3, wherein the explosive charge has a height within the charge case in an axial direction from the initiation end toward the discharge end, and wherein the holes on the periphery are to a depth of between 0.050 to 0.150 inches below the height of the explosive charge.

Statement 8. The shaped charge of any of Statements 1 to 7, wherein an angular spacing of the voids along the periphery is between 65 to 135% of a target rim debris length in response to detonation of the shaped charge.

Statement 9. The shaped charge of any of Statements 1-8, wherein the target rim debris length upon detonation of the shaped charge is less than 15 mm.

Statement 10. The shaped charge of any of Statements 1-9, wherein the voids are radially staggered along the periphery.

Statement 11. The shaped charge of any of Statements 1-10, wherein the voids comprise multiple clusters of voids, wherein a spacing between the voids in each cluster is less than a spacing between adjacent clusters.

Statement 12. A shaped charge for a downhole perforating gun, comprising:

a charge case having an initiation end and a discharge end, the charge case including a periphery formed of a parent material interspersed with a plurality of inclusions of dissimilar material properties; an explosive charge disposed within the charge case; and a liner disposed within the charge case over the explosive charge.

Statement 13. The shaped charge of Statement 12, wherein the inclusions comprise a plurality of spaced apart hardened particles embedded in the parent material.

Statement 14. The shaped charge of Statement 12 or 13, wherein the inclusions comprise spaced apart regions of local hardening formed in the parent material.

Statement 15. A method of perforating a well, comprising: interspersing a plurality of inclusions and voids of a material along a periphery of a charge case for a shaped charge with an explosive material disposed within the charge case; disposing the shaped charge downhole in a well; and detonating the shaped charge to preferentially fragment the charge case along the periphery between the inclusions.

Statement 16. The method of Statement 15, further comprising: spacing the plurality of inclusions along the periphery such that the charge case is fragmented into multiple fragments of less than 15 mm each.

Statement 17. The method of Statement 15 or 16, further comprising: forming the voids of the material by forming holes in a parent material of the charge case, wherein the inclusion comprise a remaining parent material along the periphery of the charge case.

Statement 18. The method of any of Statement 15-17, further comprising: producing hydrocarbon fluid through one or more perforations in the well formed by detonating the shaped charge.

Statement 19. A perforating gun, comprising: a plurality of shaped charges each including a charge case having an initiation end, a discharge end, and a periphery formed of a plurality of inclusions of a material interspersed with a plurality of voids of the material; and a charge carrier having a plurality of mounting holes each for receiving one of the shaped charges, each mounting hole comprising a retention feature engaging the charge case for retaining the received shaped charge within the mounting hole.

Statement 20. The perforating gun of Statement 19, wherein each charge case further comprises a mounting flange along the periphery of the charge case, wherein the voids are each at least partially on the flange, and wherein the retention feature on the charge carrier retains the charge case by engagement with the flange.

Statement 21. The perforating gun of Statement 19 or 20, wherein an angular spacing of the voids along the periphery is between 65 to 135% of a target rim debris length in response to detonation of the shaped charge.

Statement 22. The perforating gun of any of Statements 19-21, wherein the explosive charge has a height within the charge case in an axial direction from the initiation end toward the discharge end, and wherein the voids comprise holes on the periphery that are to a depth of between 0.050 to 0.150 inches below the height of the explosive charge.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A shaped charge for a downhole perforating gun, comprising:

a charge case having an initiation end and a discharge end, the charge case including a periphery formed of a plurality of inclusions of a material interspersed with a plurality of voids of the material, wherein the material is a parent material of the charge case, the voids of the material comprise holes formed on the periphery of the charge case, and the inclusions comprise the parent material remaining on the periphery of the charge case between the holes;

an explosive charge disposed within the charge case, wherein the explosive charge has a height within the charge case in an axial direction from the initiation end toward the discharge end, and wherein the holes on the periphery are to a depth of between 0.050 to 0.150 inches below the height of the explosive charge; and a liner disposed within the charge case over the explosive charge.

2. The shaped charge of claim 1, further comprising:

a mounting flange along the periphery of the charge case for mounting the shaped charge on a charge carrier, wherein the voids are each at least partially on the flange.

3. The shaped charge of claim 1, wherein the holes penetrate the periphery of the charge case in an axial direction from the discharge end toward the initiation end without passing fully through the charge case.

4. The shaped charge of claim 3, wherein the holes taper radially inwardly in an axial direction toward the initiation end of the charge case.

5. The shaped charge of claim 3, wherein the holes have a non-circular cross-section.

6. The shaped charge of claim 1, wherein an angular spacing of the voids along the periphery is between 65 to 135% of a target rim debris length in response to detonation of the shaped charge.

7. The shaped charge of claim 6, wherein the target rim debris length upon detonation of the shaped charge is less than 15 mm.

8. A shaped charge for a downhole perforating gun, comprising:

a charge case having an initiation end and a discharge end, the charge case including a periphery formed of a plurality of inclusions of a material interspersed with a plurality of voids of the material;

an explosive charge disposed within the charge case; and a liner disposed within the charge case over the explosive charge wherein the voids are radially staggered along the periphery.

9. The shaped charge of claim 8, further comprising:

a mounting flange along the periphery of the charge case for mounting the shaped charge on a charge carrier, wherein the voids are each at least partially on the flange.

10. The shaped charge of claim 8, wherein the material is a parent material of the charge case, the voids of the material comprise holes formed on the periphery of the charge case, and the inclusions comprise the parent material remaining on the periphery of the charge case between the holes.

11. The shaped charge of claim 8, wherein an angular spacing of the voids along the periphery is between 65 to 135% of a target rim debris length in response to detonation of the shaped charge.

12. A shaped charge for a downhole perforating gun, comprising:

a charge case having an initiation end and a discharge end, the charge case including a periphery formed of a plurality of inclusions of a material interspersed with a plurality of voids of the material, wherein the voids comprise multiple clusters of voids, wherein a spacing between the voids in each cluster is less than a spacing between adjacent clusters;

an explosive charge disposed within the charge case; and a liner disposed within the charge case over the explosive charge.

13. The shaped charge of claim 12, further comprising:

a mounting flange along the periphery of the charge case for mounting the shaped charge on a charge carrier, wherein the voids are each at least partially on the flange.

14. The shaped charge of claim 12, wherein the material is a parent material of the charge case, the voids of the material comprise holes formed on the periphery of the charge case, and the inclusions comprise the parent material remaining on the periphery of the charge case between the holes.

15. The shaped charge of claim 12, wherein an angular spacing of the voids along the periphery is between 65 to 135% of a target rim debris length in response to detonation of the shaped charge.

16. A shaped charge for a downhole perforating gun, comprising:

a charge case having an initiation end and a discharge end, the charge case including a periphery formed of a parent material interspersed with a plurality of inclusions of dissimilar material properties, wherein the inclusions comprise spaced apart regions of local hardening formed in the parent material;

an explosive charge disposed within the charge case; and a liner disposed within the charge case over the explosive charge.

17. The shaped charge of claim 16, wherein the inclusions comprise a plurality of spaced apart hardened particles embedded in the parent material.

18. A perforating gun, comprising:

a plurality of shaped charges each including a charge case having an initiation end, a discharge end, and a periphery formed of a plurality of inclusions of a material interspersed with a plurality of voids of the material;

an explosive charge disposed in the charge case, wherein the explosive charge has a height within the charge case in an axial direction from the initiation end toward the discharge end, and wherein the holes on the periphery are to a depth of between 0.050 to 0.150 inches below the height of the explosive charge; and a charge carrier having a plurality of mounting holes each for receiving one of the shaped charges, each mounting hole comprising a retention feature engaging the charge case for retaining the received shaped charge within the mounting hole.

19. The perforating gun of claim 18, wherein each charge case further comprises a mounting flange along the periphery of the charge case, wherein the voids are each at least partially on the flange, and wherein the retention feature on the charge carrier retains the charge case by engagement with the flange.

20. The perforating gun of claim 18, wherein an angular spacing of the voids along the periphery is between 65 to 135% of a target rim debris length in response to detonation of the shaped charge.

* * * * *